US010801403B2

(12) United States Patent
Nishikawa et al.

(10) Patent No.: US 10,801,403 B2
(45) Date of Patent: Oct. 13, 2020

(54) INTERNAL COMBUSTION ENGINE

(71) Applicant: TOYOTA JIDOSHA KABUSHIKI KAISHA, Toyota-shi, Aichi-ken (JP)

(72) Inventors: Naoki Nishikawa, Toyota (JP); Akio Kawaguchi, Shizuoke-ken (JP); Hideo Yamashita, Mishima (JP); Keisuke Tanaka, Susono (JP); Toshio Horie, Nagakute (JP); Yoshifumi Wakisaka, Nagakute (JP); Fumio Shimizu, Nagakute (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/452,786

(22) Filed: Jun. 26, 2019

(65) Prior Publication Data

US 2020/0011237 A1 Jan. 9, 2020

(30) Foreign Application Priority Data

Jul. 4, 2018 (JP) ..... 2018-127729

(51) Int. Cl.
*F02B 77/02* (2006.01)
*C25D 11/08* (2006.01)
(Continued)

(52) U.S. Cl.
CPC ..... *F02B 77/02* (2013.01); *C25D 11/08* (2013.01); *C25D 11/26* (2013.01); *F02B 77/11* (2013.01);
(Continued)

(58) Field of Classification Search
CPC ..... F02B 77/02; F02B 77/11; C25D 11/08; C25D 11/26; C25D 11/04; C25D 11/18;
(Continued)

(56) References Cited

U.S. PATENT DOCUMENTS

2014/0245994 A1* 9/2014 Nishikawa ..... F02B 77/11 123/434
2016/0186654 A1* 6/2016 Takagishi ..... C25D 11/246 123/668
2017/0254294 A1* 9/2017 Murakami ..... F02F 1/004

FOREIGN PATENT DOCUMENTS

DE 102017104090 A1 9/2017
JP 2013-060620 A 4/2013
(Continued)

*Primary Examiner* — Syed O Hasan
(74) *Attorney, Agent, or Firm* — Dickinson Wright PLLC

(57) ABSTRACT

The present embodiment relates to an internal combustion engine having an anodic oxide coating formed on at least a portion of an aluminum-based wall surface facing a combustion chamber. The anodic oxide coating has a plurality of nanopores extending substantially in the thickness direction of the anodic oxide coating, a first micropore extending from the surface toward the inside of the anodic oxide coating, and a second micropore present in the inside of the anodic oxide coating; the surface opening diameter of the nanopores is 0 nm or larger and smaller than 30 nm; the inside diameter of the nanopores is larger than the surface opening diameter; the film thickness of the anodic oxide coating is 15 μm or larger and 130 μm or smaller; and the porosity of the anodic oxide coating is 23% or more.

16 Claims, 10 Drawing Sheets

(51) Int. Cl.

| | |
|---|---|
| ***C25D 11/26*** | (2006.01) |
| ***F02B 77/11*** | (2006.01) |
| ***F02F 3/14*** | (2006.01) |
| *F02F 1/00* | (2006.01) |
| *F02F 1/24* | (2006.01) |

(52) U.S. Cl.
CPC ..... *F02F 3/14* (2013.01); *F02F 2001/008* (2013.01); *F02F 2001/249* (2013.01); *F05C 2203/0869* (2013.01); *F05C 2251/048* (2013.01); *F05C 2253/12* (2013.01)

(58) Field of Classification Search
CPC ..... F02F 3/14; F02F 2001/249; F05C 2203/0869
See application file for complete search history.

(56) References Cited

FOREIGN PATENT DOCUMENTS

| | | | |
|---|---|---|---|
| JP | 2014227855 | A | 12/2014 |
| JP | 2015-031226 | A | 2/2015 |
| JP | 2016-216763 | A | 12/2016 |
| JP | 2017122271 | A | 7/2017 |
| JP | 2017155639 | A | 9/2017 |
| WO | 2012025812 | A2 | 3/2012 |
| WO | 2013/038249 | A2 | 3/2013 |
| WO | 2015/019145 | A2 | 2/2015 |

* cited by examiner

COMPARATIVE EXAMPLE

COMPARATIVE EXAMPLE

RELATIONSHIP BETWEEN FILM THICKNESS
AND POROSITY ACHIEVED IN 45 ms

INTERNAL COMBUSTION ENGINE

INCORPORATION BY REFERENCE

The disclosure of Japanese Patent Application No. 2018-127729 filed on Jul. 4, 2018 including the specification, drawings and abstract is incorporated herein by reference in its entirety.

BACKGROUND

1. Technical Field

The present disclosure relates to an internal combustion engine.

2. Description of Related Art

Internal combustion engines such as gasoline engines or diesel engines are typically constituted by an engine block, a cylinder head, and a piston. A combustion chamber of the internal combustion engine is defined by the bore surface of the cylinder block, the top surface of the piston assembled in the bore, the bottom face of the cylinder head and the top surfaces of intake and exhaust valves arranged in the cylinder head. As higher power is required for recent internal combustion engines, it is desired to reduce the cooling loss of the internal combustion engines. One example of a mean for reducing the cooling loss includes a method of forming a heat insulation coating on the inner wall of the combustion chamber.

The heat insulation coating that is formed on the wall surface of the combustion chamber is desirably formed from a material having not only heat resistance and heat insulation properties but a low thermal conductivity and a low thermal capacity. Specifically, for preventing steady elevation in wall temperature, it is desirable that the heat insulation coating should have a low thermal capacity so as to lower the wall temperature following a fresh air temperature in an intake stroke. Furthermore, in addition to the low thermal conductivity and the low thermal capacity, the coating is desirably capable of resisting explosion pressure at the time of combustion in the combustion chamber, injection pressure, and repeated stress of thermal expansion and thermal shrinkage, and has a high adhesion to a base material, such as a cylinder block.

An anodic oxide coating can be used as an example of such a heat insulation coating. The anodic oxide coating can be formed on a wall surface facing the combustion chamber of the internal combustion engine to thereby prepare an internal combustion engine having excellent heat insulation properties, low thermal conductivity, and a low thermal capacity. In addition to these capabilities, excellent swing characteristics are also an important capability required for the anodic oxide coating. In this context, the "swing characteristics" are characteristics by which the temperature of the anodic oxide coating follows a gas temperature in the combustion chamber although the anodic oxide coating possesses a heat insulation capability.

Examples of literatures disclosing the internal combustion engine having the anodic oxide coating formed on a wall surface facing the combustion chamber include Japanese Patent Application Publication Nos. 2013-60620 and 2015-31226 described below.

JP 2013-60620 A discloses an internal combustion engine prepared by forming an anodic oxide coating on a portion or the whole of a wall surface facing a combustion chamber, wherein the anodic oxide coating has, in the inside, voids and nanopores much smaller than the voids; and the internal combustion engine assumes a structure where at least one or some of the voids are sealed with a sealing material converted from a sealant, and at least one or some of the nanopores are not sealed. In JP 2013-60620 A, a sealing material is disposed on the surface of the anodic oxide coating.

JP 2015-31226 A discloses an internal combustion engine prepared by forming an anodic oxide coating on a portion or the whole of an aluminum-based wall surface facing a combustion chamber, wherein the anodic oxide coating has a film thickness in the range of 30 μm to 170 μm; the anodic oxide coating has first micropores having a microsized diameter and extending in the thickness direction or substantially in the thickness direction of the anodic oxide coating from the surface toward the inside of the anodic oxide coating, nanopores having a nanosized diameter and extending in the thickness direction or substantially in the thickness direction of the anodic oxide coating from the surface toward the inside of the anodic oxide coating, and second micropores having a microsized diameter and being present in the inside of the anodic oxide coating; and the internal combustion engine assumes a structure where at least one or some of the first micropores and the nanopores are sealed with a sealing material converted from a sealant, and at least one or some of the second micropores are not sealed. In JP 2015-31226 A, as in JP 2013-60620 A, a sealing material is disposed on the surface of the anodic oxide coating.

SUMMARY

In JP 2013-60620 A and JP 2015-31226 A, coating strength is improved by disposing a sealing material on an anodic oxide coating. However, use of a sealant seals pores present in the anodic oxide coating and therefore reduces a porosity, which is important for obtaining favorable swing characteristics. Furthermore, the presence of the sealant increases a thermal capacity and may not produce favorable swing characteristics. Moreover, a cost is increased because an operation of disposing the sealant, a material, etc. are necessary.

On the other hand, the mere absence of the sealant causes combustion gas to invade nanopores. Upon entry of combustion gas into the nanopores, a heat insulation effect is decreased in the portion where the gas has entered, leading to reduction in the heat insulation effect of the film as a whole. As a result, for conferring sufficient heat insulation properties, it becomes necessary to increase the thickness of the anodic oxide coating. However, the increased thickness of the anodic oxide coating in turn leads to reduction in swing characteristics.

The present disclosure provides an internal combustion engine having a formed anodic oxide coating having favorable heat insulation properties and swing characteristics.

(1) An aspect of the present disclosure relates to an internal combustion engine having an anodic oxide coating formed on at least a portion of an aluminum-based wall surface facing a combustion chamber. The anodic oxide coating has a plurality of nanopores extending substantially in a thickness direction of the anodic oxide coating, a first micropore extending from the surface toward the inside of the anodic oxide coating, and a second micropore present in the inside of the anodic oxide coating. The surface opening diameter of the nanopores on the surface of the anodic oxide coating is 0 nm or larger and smaller than 30 nm. The inside diameter of the nanopores in the inside of the anodic oxide coating is larger than the surface opening diameter. A film thickness of the anodic oxide coating is 15 μm or larger and 130 μm or smaller. The porosity of the anodic oxide coating is 23% or more.

(2) The difference between the surface opening diameter and the inside diameter of the nanopores may be 7 nm or larger.

(3) The nanopores may not open to the surface of the anodic oxide coating.

(4) The difference between the surface opening diameter and the inside diameter of the nanopores may be 20 nm or larger.

(5) An aluminum-based material constituting the aluminum-based wall surface may contain at least one metal selected from Si and Cu, and the content of the metal in the aluminum-based material may be 5% by mass or more.

(6) No sealing material may be disposed on the anodic oxide coating.

(7) The anodic oxide coating may be exposed to the combustion chamber.

(8) The internal combustion engine may have a piston, and the anodic oxide coating may be formed at least on a piston top surface.

(9) The anodic oxide coating formed on the piston top surface may include a thin-film portion having the film thickness of 15 μm or larger and 60 μm or smaller.

(10) The thin-film portion may be disposed in a portion substantially contributing to the formation of a tumble flow in the piston top surface.

(11) The film thickness of the anodic oxide coating formed on the piston top surface except for the thin-film portion may be larger than 60 μm and 100 μm or smaller.

(12) The piston top surface may include a cavity portion, and the thin-film portion may be disposed in the cavity portion.

(13) The piston top surface may further include valve recess portions, and the thin-film portion may also be disposed in the valve recess portions in addition to the cavity portion.

(14) The piston top surface may further include a squish portion, and the film thickness of the anodic oxide coating in the squish portion may be larger than 60 μm and 100 μm or smaller.

(15) The thin-film portion may be disposed in a central region including the center of the piston top surface, and the film thickness of the anodic oxide coating disposed in an outer region positioned on the outer side of the central region may be larger than 60 μm and 100 μm or smaller.

(16) The ratio between the area Sc of the central region and the area So of the outer region (Sc:So) may be 1:5 to 5:1.

The present disclosure can provide an internal combustion engine having a formed anodic oxide coating having favorable heat insulation properties and swing characteristics.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

The present embodiment relates to an internal combustion engine having an anodic oxide coating formed on at least a portion of an aluminum-based wall surface facing a combustion chamber, wherein the anodic oxide coating has a plurality of nanopores extending substantially in the thickness direction of the anodic oxide coating, a first micropore extending from the surface toward the inside of the anodic oxide coating, and a second micropore present in the inside of the anodic oxide coating; the surface opening diameter of the nanopores on the surface of the anodic oxide coating is 0 nm or larger and smaller than 30 nm; the inside diameter of the nanopores in the inside of the anodic oxide coating is larger than the surface opening diameter; the film thickness of the anodic oxide coating is 15 μm or larger and 130 μm or smaller; and the porosity of the anodic oxide coating is 23% or more.

The present embodiment can provide an internal combustion engine having a formed anodic oxide coating having favorable heat insulation properties and swing characteristics. More specifically, in the present embodiment, the nanopores have a narrow surface opening diameter. Hence, the invasion of combustion gas into the nanopores is reduced, so that the anodic oxide coating is capable of having high heat insulation properties. Furthermore, the film thickness of the anodic oxide coating is as small as 15 μm or larger and 130 μm or smaller while the porosity falls within the predetermined range. The resulting anodic oxide coating achieves a lower thermal capacity and can also have excellent swing characteristics.

Hereinafter, the configuration of the internal combustion engine of the present embodiment will be described with reference to the drawings.

Figure 1:
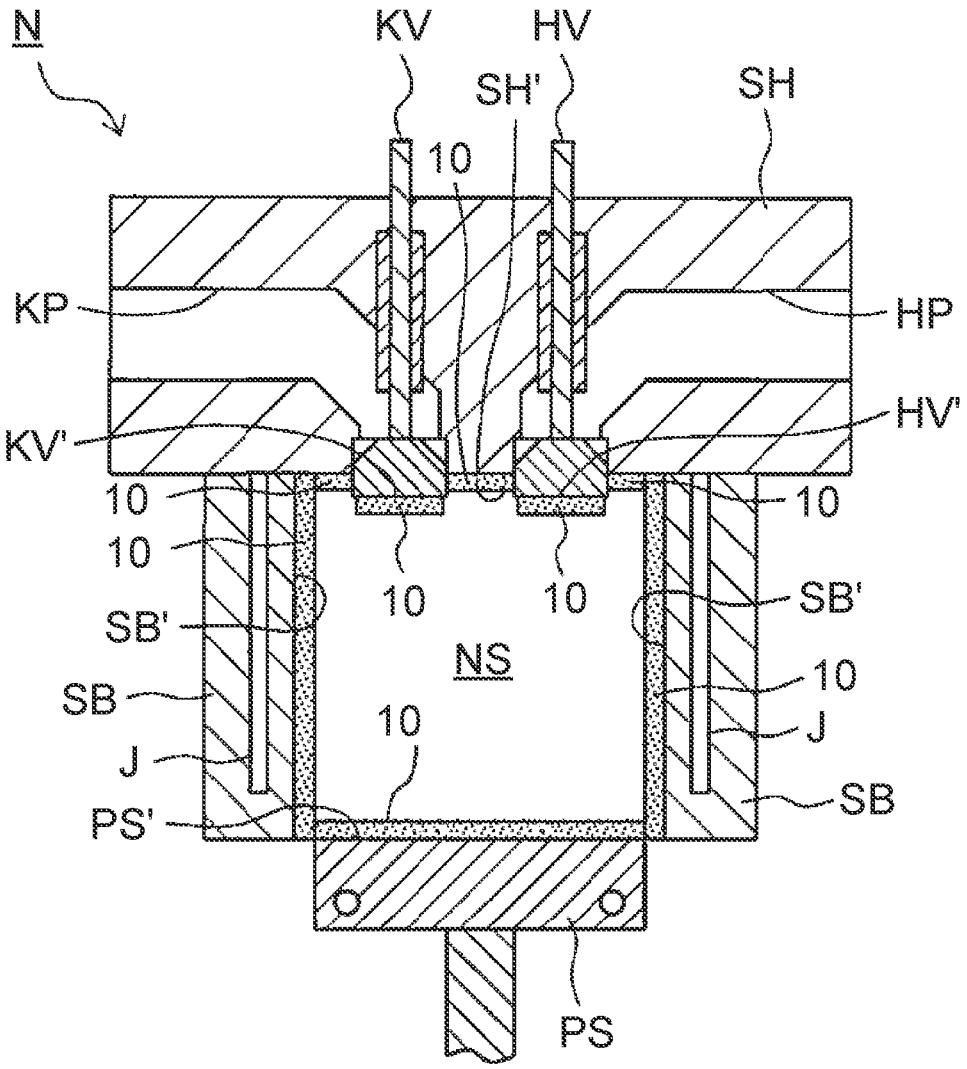
FIG. 1 is a schematic sectional view illustrating a configuration example of the internal combustion engine according to the present embodiment.

FIG. 1 is a schematic sectional view illustrating a configuration example of the internal combustion engine according to the present embodiment. In FIG. 1, an anodic oxide coating 10 is formed on the whole of a wall surface facing a combustion chamber. The internal combustion engine N shown in FIG. 1 is intended for diesel engines and is approximately constituted by: a cylinder block SB having a coolant jacket J formed in the inside; a cylinder head SH arranged on the cylinder block SB; an intake port KP and an exhaust port HP defined in the cylinder head SH; an intake valve KV and an exhaust valve HV attached movably up and down to openings at which the intake port KP and the exhaust port HP, respectively, face a combustion chamber NS; and a piston PS formed movably up and down from the lower opening of the cylinder block SB. In the combustion chamber NS defined by each member constituting the internal combustion engine N, the anodic oxide coating 10 is formed on the wall surface (cylinder bore surface SB', cylinder head bottom face SH', piston top surface PS', and valve top surfaces KV', HV') on which each component faces the combustion chamber NS.

In the present embodiment, the internal combustion engine may be intended for any of gasoline engines and diesel engines. As for the configuration of the internal combustion engine, the internal combustion engine is typically constituted by an engine block, a cylinder head, and a piston as already mentioned. A combustion chamber of the internal combustion engine is defined by, for example, the bore surface of the cylinder block, the top surface of the piston assembled in the bore, the bottom face of the cylinder head and the top surfaces of intake and exhaust valves arranged in the cylinder head.

In the present embodiment, each member constituting the internal combustion engine is made of an aluminum-based material. The aluminum-based wall surface is the wall surface of a wall member made of an aluminum-based material. Examples of the aluminum-based material include aluminum and alloys thereof, and aluminum-plated iron-based materials. The aluminum-based material includes, for example, a high-strength aluminum alloy. An anodic oxide coating formed by anodization on a wall surface with aluminum or an alloy thereof as a base material is alumite.

Figure 2:
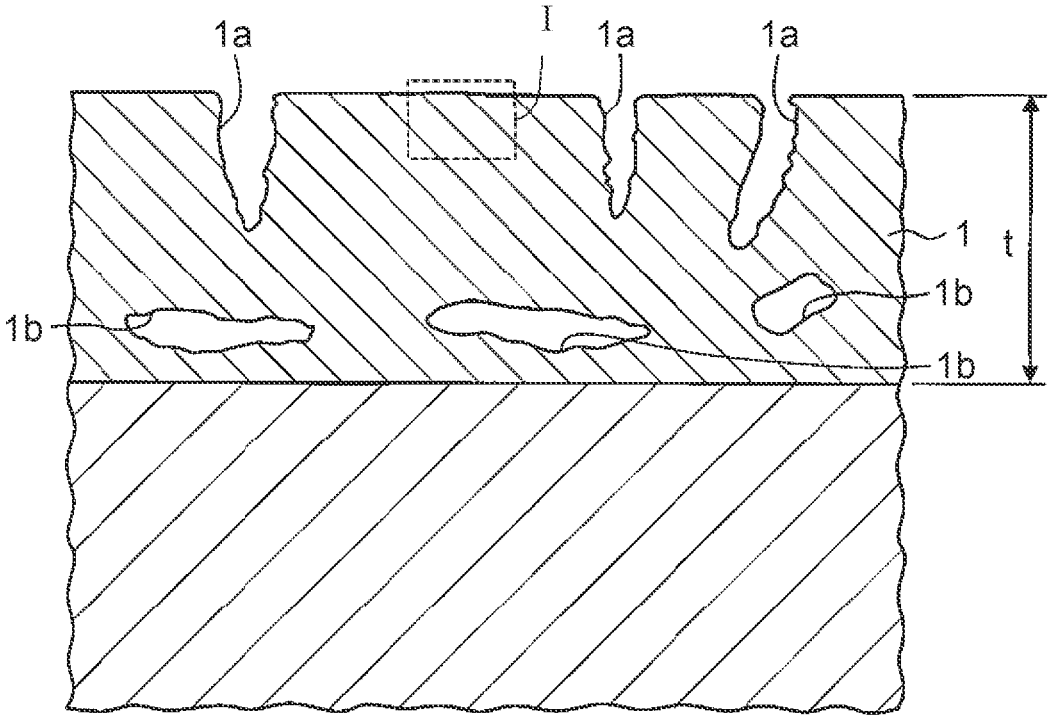
FIG. 2 is a schematic sectional view illustrating a configuration example of an anodic oxide coating formed on an aluminum-based wall surface facing a combustion chamber of the internal combustion engine according to the present embodiment.
Figure 3:
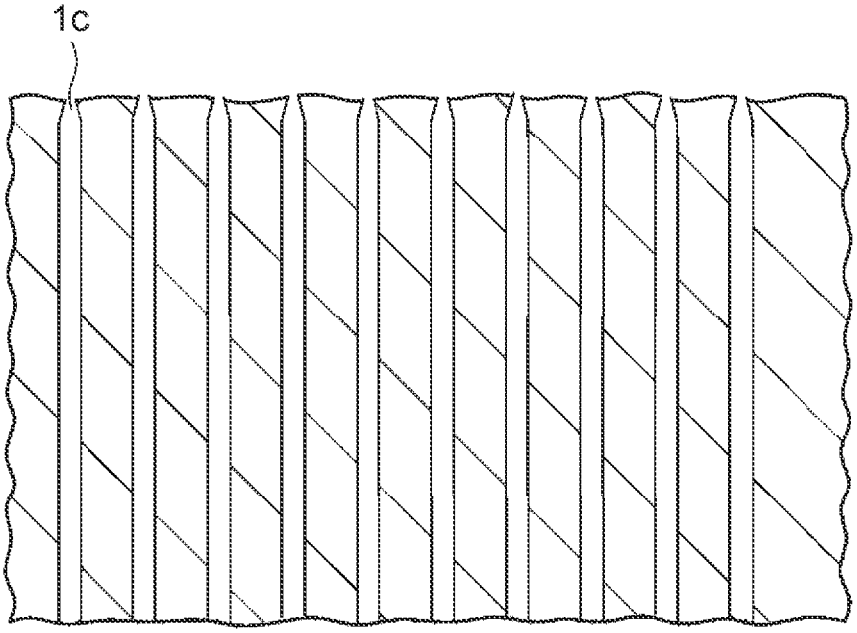
FIG. 3 is an enlarged view of a portion I of FIG. 2.

FIG. 2 is a diagrammatic sectional view illustrating a configuration example of the anodic oxide coating formed on the aluminum-based wall surface facing the combustion chamber of the internal combustion engine of the present embodiment. FIG. 3 is an enlarged view of a portion I of FIG. 2 and is a diagrammatic sectional view illustrating the structure of the nanopores. In FIG. 2, the aluminum-based wall surface is anodized to form an anodic oxide coating 1. The anodic oxide coating 1 has a plurality of nanopores 1*c* (FIG. 3) extending substantially in the thickness direction of the anodic oxide coating 1 from the surface toward the inside of the anodic oxide coating 1, first micropores 1*a* extending from the surface toward the inside of the anodic oxide coating 1, and second micropores 1*b* present in the inside of the anodic oxide coating. As shown in FIG. 3, the nanopores 1*c* open to the surface of the anodic oxide coating, and the opening diameter of the nanopores on the surface of the anodic oxide coating is smaller than the inside opening diameter of the nanopores. As shown in FIG. 2, first micropores 1*a* (cracks) extending substantially in the thickness direction of the anodic oxide coating 1 are present on the surface of the anodic oxide coating 1 formed on the aluminum-based wall surface constituting the wall surface of the combustion chamber. Also, second micropores 1*b* (inner defects) are present in the inside of the anodic oxide coating 1.

In the present specification, the "nanopore" means a nanosized pore extending substantially in the thickness direction of the anodic oxide coating. The nanosize means that the diameter of a circle (also referred to as a circle-equivalent diameter) having the same area as the maximum sectional area (sectional area at a horizontal section where the area is largest) of the nanopores is of the order of nm (1 nm or larger and smaller than 1 μm). The nanopores are not necessarily required to open to the surface of the anodic oxide coating and may not open to the coating surface. The horizontal direction means the planar direction of the aluminum-based wall surface.

In the present specification, the "first micropore" means a pore (e.g., a crack) extending from the surface toward the inside of the anodic oxide coating. The first micropore opens to the surface of the anodic oxide coating, and the diameter of a circle (circle-equivalent diameter) having the same area as the opening area of the first micropore is of the order of μm (1 μm or larger). The first micropore usually extends substantially in the thickness direction of the anodic oxide coating from the surface toward the inside of the anodic oxide coating.

In the present specification, the "second micropore" means a pore (e.g., an inner defect) present in the inside of the anodic oxide coating. The second micropore does not face the surface of the anodic oxide coating, i.e., does not open to the surface of the anodic oxide coating. The diameter of a circle having the same area as the maximum sectional area (sectional area at a horizontal section where the area is largest) of the second micropore is of the order of μm (1 μm or larger). The circle-equivalent diameter of the second micropore is, for example, in the range of 1 to 100 μm.

The nanopores and the first micropore extend substantially in the thickness direction of the anodic oxide coating. The phrase "substantially in the thickness direction" is meant to include a form extending in a direction sloped from the thickness direction, a form extending while meandering zigzag from the thickness direction, etc. The form of the second micropore includes a form extending in a direction orthogonal to the thickness direction of the anodic oxide coating, a form extending in a direction sloped from the direction orthogonal to the thickness direction of the anodic oxide coating, a form extending while meandering zigzag in the direction orthogonal to the thickness direction of the anodic oxide coating, etc. in the inside of the anodic oxide coating.

The opening diameters of the nanopores and the micropores can be measured by extracting each micropore or nanopore from a given area in SEM image photograph data or TEM image photograph data on the cross-section of the anodic oxide coating, measuring the diameters (circle-equivalent diameters) of the extracted pores, and determining an average value.

In the present embodiment, the anodic oxide coating may be formed on the whole of the wall surface facing the combustion chamber or may be formed only on a portion of the wall surface. Examples of the latter embodiment can include a mode in which the coating is formed only on the piston top surface or only on the valve top surfaces.

In the present embodiment, the anodic oxide coating can be formed by anodizing the aluminum-based wall surface facing the combustion chamber of the internal combustion engine.

In the present embodiment, the opening diameter of the nanopores on the surface of the anodic oxide coating is 0 nm or larger and smaller than 30 nm. When the surface opening diameter of the nanopores is smaller than 30 nm, the invasion of gas into the nanopores can be effectively reduced. The reduction in the invasion of combustion gas can curb decrease in heat insulation effect. If the invasion of combustion gas into the inside of the coating cannot be reduced, a heat insulation effect is decreased in the portion invaded by the gas. Therefore, the heat insulation effect of the film as a whole is also decreased. The surface opening diameter of the nanopores is preferably 20 nm or smaller, more preferably 15 nm or smaller, further preferably 10 nm or smaller, particularly preferably 5 nm or smaller, from the viewpoint of effectively reducing the invasion of gas. The surface opening diameter of the nanopores is more preferably 0 nm. Specifically, it is more preferred that the nanopores should not open to the surface of the anodic oxide coating. When the nanopores have no opening to the surface of the anodic oxide coating, the invasion of gas into the nanopores is markedly reduced.

In the present embodiment, the pore size of the nanopores in the inside of the anodic oxide coating (also referred to as an inside diameter) is larger than the surface opening diameter mentioned above. Specifically, the nanopores are formed at the time of anodization of the aluminum-based wall surface. The diameter of the nanopores is small at the opening of the coating surface and is gradually increased from the surface to a certain depth (e.g., approximately 10 μm from the opening), and the subsequent nanopores extend from the surface toward the inside while keeping an almost constant sectional area (horizontal sectional area). The "inside opening diameter of the nanopores" or the "opening diameter of the nanopores in the inside" refers to the opening diameter of the pore portion extending while keeping an almost constant sectional area. The inside diameter of the nanopores is, for example, 25 nm or larger, 30 nm or larger, 35 nm or larger, 40 nm or larger, or 50 nm or larger.

The surface opening diameter of the nanopores can be obtained by determining the circle-equivalent diameter (average value) of the nanopores from a SEM image of the surface of the anodic oxide coating. The circle-equivalent diameter of the nanopores can be determined from the SEM image using commercially available software. Examples of the software can include WinROOF (manufactured by Mitani Corp.).

The inside diameter of the nanopores can be obtained by shaving the anodic oxide coating from the surface to the predetermined depth using a cross-section polisher or the like, photographing the exposed surface under SEM, and determining the circle-equivalent diameter of the nanopores from the obtained image. The circle-equivalent diameter can be determined from the SEM image using commercially available software, as in the surface opening diameter. The "inside diameter of the nanopores" can be measured, for example, in the middle of the thickness direction of the anodic oxide coating.

Figure 4A:
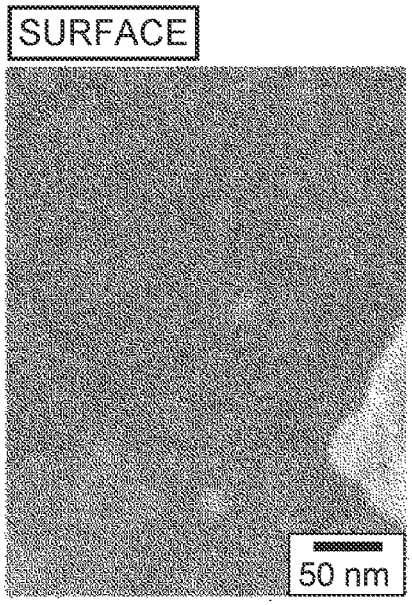
FIG. 4A is a SEM image of the surface of a test piece E4 obtained in Example 4.
Figure 4B:
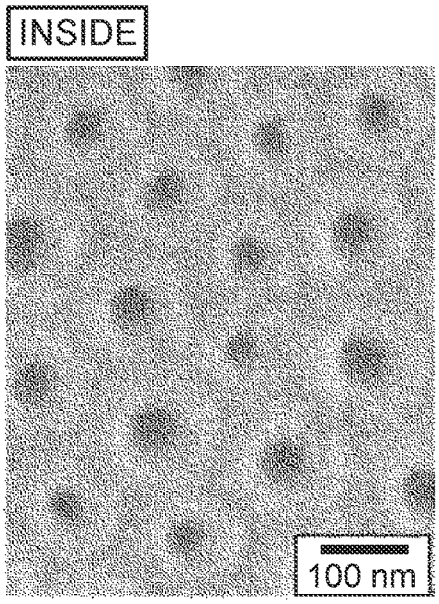
FIG. 4B is a SEM image of the inside of the test piece E4.
Figure 5A:
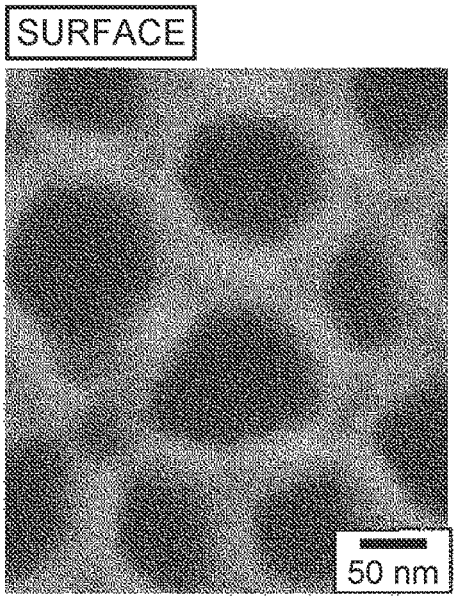
FIG. 5A is a SEM image of the surface of a test piece C2 obtained in Comparative Example 2.
Figure 5B:
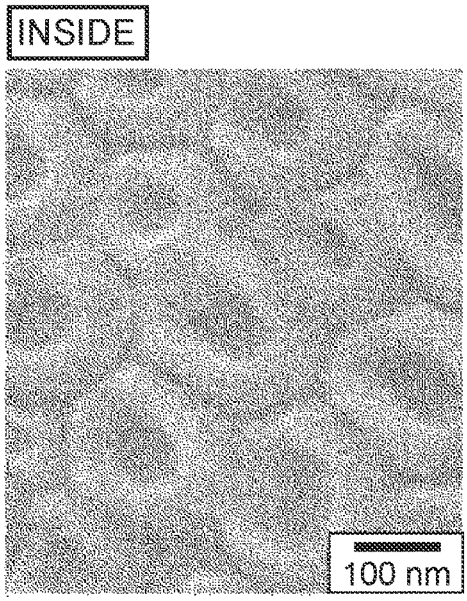
FIG. 5B is a SEM image of the inside of the test piece C2.

FIG. 4A is a SEM image of the surface of a test piece E4 obtained in Example 4, and FIG. 4B is a SEM image of the inside of the test piece E4. As shown in FIG. 4A, the nanopores do not open to the coating surface and have a structure where the invasion of combustion gas is reduced. FIG. 5A is a SEM image of the surface of a test piece C2 obtained in Comparative Example 2, and FIG. 5B is a SEM image of the inside of the test piece C2. As shown in FIG. 5A, the nanopores open with a large size to the coating surface and have a structure susceptible to the invasion of combustion gas.

In the present embodiment, the difference between the surface opening diameter and the inside diameter of the nanopores is preferably 7 nm or larger, more preferably 10 nm or larger, still more preferably 15 nm or larger, further preferably 20 nm or larger. A larger difference between the surface opening diameter and the inside diameter of the nanopores can increase a porosity. In a specific embodiment, the nanopores do not open to the coating surface and preferably have an inside diameter of 20 nm or larger, more preferably 25 nm or larger, further preferably 30 nm or larger.

In the present embodiment, the film thickness (indicated by t in FIG. 2) of the anodic oxide coating is 15 μm or larger and 130 μm or smaller. In the present embodiment, the porosity of the anodic oxide coating is 23% or more. The porosity of the anodic oxide coating is preferably 80% or less. In the present embodiment, the anodic oxide coating is as thin as the thickness of 15 μm or larger and 130 μm or smaller. Nonetheless, the anodic oxide coating is excellent in heat insulation properties and also excellent in swing characteristics in spite of being a thin layer, because of the surface opening diameter of the nanopores smaller than the inside diameter and the predetermined porosity. Furthermore, such a small film thickness of the anodic oxide coating shortens the time required for the formation of the anodic oxide coating and can thereby achieve reduction in production cost.

The film thickness can be obtained by measuring film thicknesses at 5 sites at the cross-section of the anodic oxide coating, and determining an average value.

The porosity can be measured by the following method: the volume of the coating is determined from the area and the film thickness of the anodic oxide coating. Also, the weight of the coating is determined from the difference in weight before and after removal of the coating. The bulk density of the coating is calculated. The porosity is calculated according to the following expression using the obtained bulk density of the coating and an alumina density (3.9 g/cm$^3$): Porosity=1−(Bulk density of the coating/Alumina density)

In the present embodiment, the aluminum-based material constituting the aluminum-based wall surface preferably contains 5% by mass or more of at least one metal selected from Si and Cu. When the content of at least one metal selected from Si and Cu in the aluminum-based material is 5% by mass or more, the formation of the micropores (particularly, the second micropore) can be promoted to thereby effectively improve a porosity. The content of Si in the aluminum-based material is preferably 5% by mass or more and 20% by mass or less. The content of Cu in the aluminum-based material is preferably 0.3% by mass or more and 7% by mass or less. The content of Al in the aluminum-based material is, for example, 70% by mass or more or 75% by mass or more. Also, the content of Al in the aluminum-based material is, for example, 95% by mass or less or 90% by mass or less. Examples of a metal, other than Al, Si and Cu, contained in the aluminum-based material include Mg, Zn, Ni, Fe, Mn, and Ti.

The swing characteristics of the anodic oxide coating can be evaluated by a cooling test (quenching test). In the cooling test, a test piece provided on one surface with the anodic oxide coating is used. While the back surface (surface provided with no anodic oxide coating) is continuously heated with the predetermined high-temperature jet, cooling air of the predetermined temperature is injected from the front surface (surface provided with the anodic oxide coating) of the test piece to lower the front-surface temperature of the test piece. The front surface temperature is measured. Then, a cooling curve is prepared from the coating surface temperature and the time. Further, the rate of temperature fall is evaluated from the cooling curve. This rate of temperature fall is evaluated, for example, by reading the time required for the coating surface temperature to fall by 40° C. (40° C.-fall time) from a graph.

Specifically, the quenching test is carried out on a plurality of test pieces, and a 40° C.-fall time is measured for each of the test pieces. An approximated curve is prepared as to a plurality of plots defined by the rate of improvement in fuel efficiency and the 40° C.-fall time. Then, the value of the 40° C.-fall time corresponding to 5% as the rate of improvement in fuel efficiency described above is read. When this value is 45 msec or shorter, the coating is found to have an excellent fuel efficiency-improving effect. A coating having a shorter 40° C.-fall time has a lower thermal conductivity and thermal capacity and a higher fuel efficiency-improving effect.

In the present embodiment, no sealing material is preferably disposed on the anodic oxide coating. In the present embodiment, the anodic oxide coating is preferably exposed to the combustion chamber. If a sealing material is disposed on the anodic oxide coating, the nanopores and/or the first micropore are sealed with the sealing material, leading to reduction in porosity. Furthermore, the presence of the sealing material increases a thermal capacity. Hence, it is preferred that no sealing material should be disposed on the anodic oxide coating.

Figure 15:
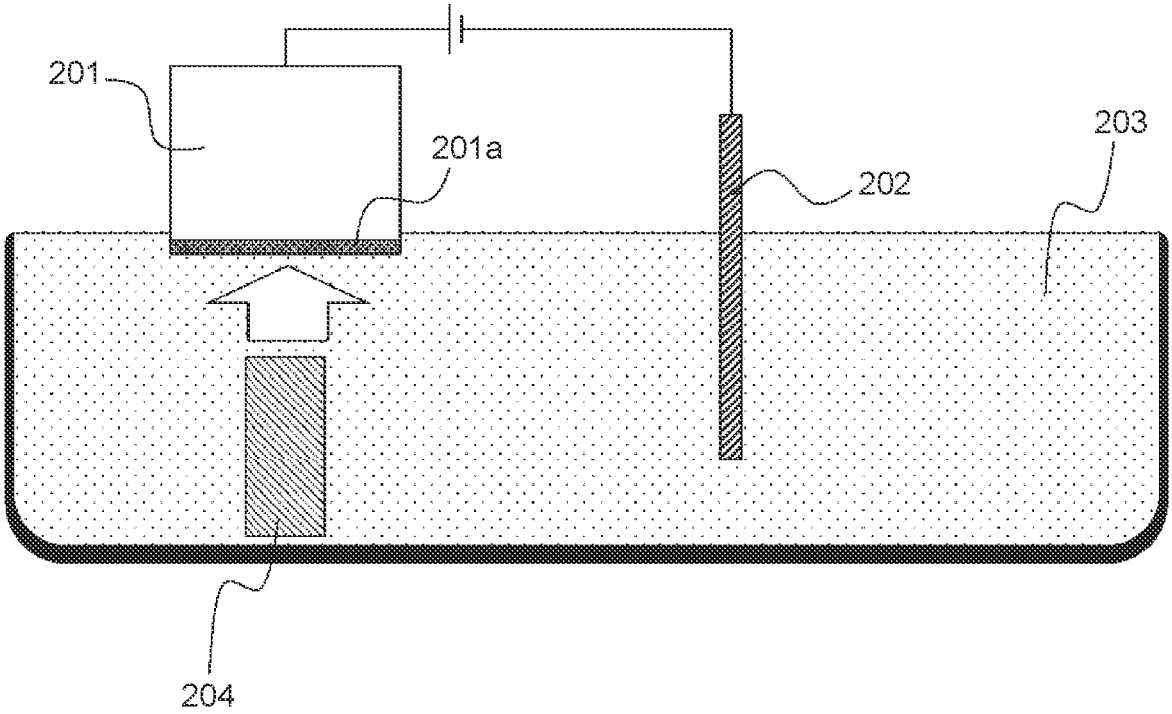
FIG. 15 is a diagrammatic view showing a configuration example of an apparatus forming the anodic oxide coating.

The anodic oxide coating of the present embodiment is prepared by dipping the aluminum-based material in an acidic electrolytic solution (e.g., an aqueous sulfuric acid solution), and electrifying the material. Specifically, in a film formation apparatus, voltage is applied to between electrodes with the electrolytic solution injected to perform electrolysis. As a result, the wall surface (e.g., the piston top surface) of the aluminum-based material is oxidized as an anode, so that the anodic oxide coating is formed. In order to form the anodic oxide coating according to the present embodiment, anodization conditions can be appropriately adjusted. For example, the porosity of the anodic oxide coating can be adjusted depending on the applied voltage. Also, the thickness of the anodic oxide coating can be adjusted depending on the application time. It is preferred to remove the heat of oxidation reaction using a cooling apparatus during film formation treatment. For removing the heat of oxidation reaction from the wall surface of the material, it is preferred to perform anodization while the electrolytic solution is allowed to flow in contact with the film formation surface. Specifically, the anodic oxide coating can be formed with an apparatus having a configuration as shown in FIG. 15. In FIG. 15, the aluminum-based material (film formation sample) functioning as an anode 201 is disposed such that a film formation surface 201*a* is dipped in an electrolytic solution 203. A cathode 202 is shown in FIG. 15. A discharge portion 204 is also disposed in the electrolytic solution 203. The discharge portion 204 discharges the electrolytic solution to generate an electrolytic solution flow. In FIG. 15, the discharge portion 204 is disposed such that the discharge port faces the film formation surface 201*a* to bring the resulting electrolytic solution flow into contact with the film formation surface 201*a*. In such a configuration adopted, the heat of oxidation reaction can be efficiently removed from the film formation surface by adjusting the flow rate of the electrolytic solution from the discharge port. The surface opening diameter of the nanopores in the anodic oxide coating can be decreased by efficiently removing the heat of oxidation reaction from the film formation surface. Furthermore, the difference between the surface opening diameter and the inside diameter of the nanopores can be increased.

The temperature of the electrolytic solution is, for example, 0° C. or higher and 10° C. or lower, preferably 0° C. or higher and 4° C. or lower.

The current density is, for example, 0.1 $A/cm^2$ or larger and 1.0 $mA/cm^2$ or smaller.

The energization time (film formation time) is, for example, 5 seconds or longer and 180 seconds or shorter.

In the present embodiment, the anodic oxide coating is preferably formed at least on the piston top surface. Specifically, the anodic oxide coating is preferably formed on the whole piston top surface of the internal combustion engine. In the present embodiment, the anodic oxide coating formed on the piston top surface preferably includes a thin-film portion having a film thickness of 15 μm or larger and 60 μm or smaller.

Figure 6:
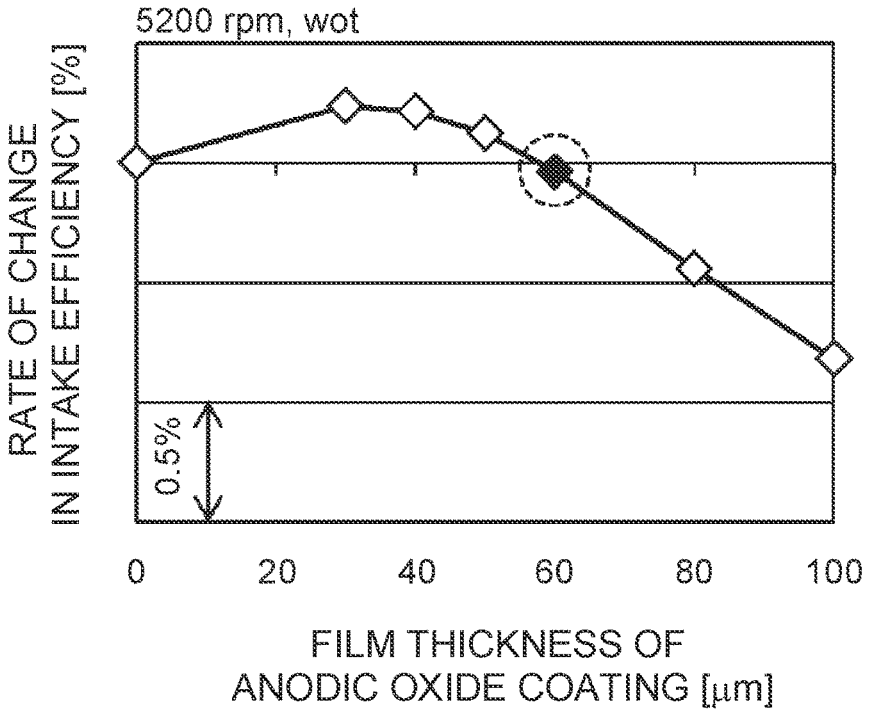
FIG. 6 shows results of simulating the rate of change in intake efficiency using varying film thicknesses of an anodic oxide coating formed on a piston top surface.

FIG. 6 shows results of simulating the rate of change in intake efficiency using varying film thicknesses of the anodic oxide coating. As shown in FIG. 6, the intake efficiency is found to be reduced when the film thickness of the anodic oxide coating exceeds 60 μm. Hence, in the present embodiment, it is preferred that the anodic oxide coating formed on the piston top surface should include a thin-film portion having a film thickness of 15 μm or larger and 60 μm or smaller, from the viewpoint of intake efficiency.

Figure 7:
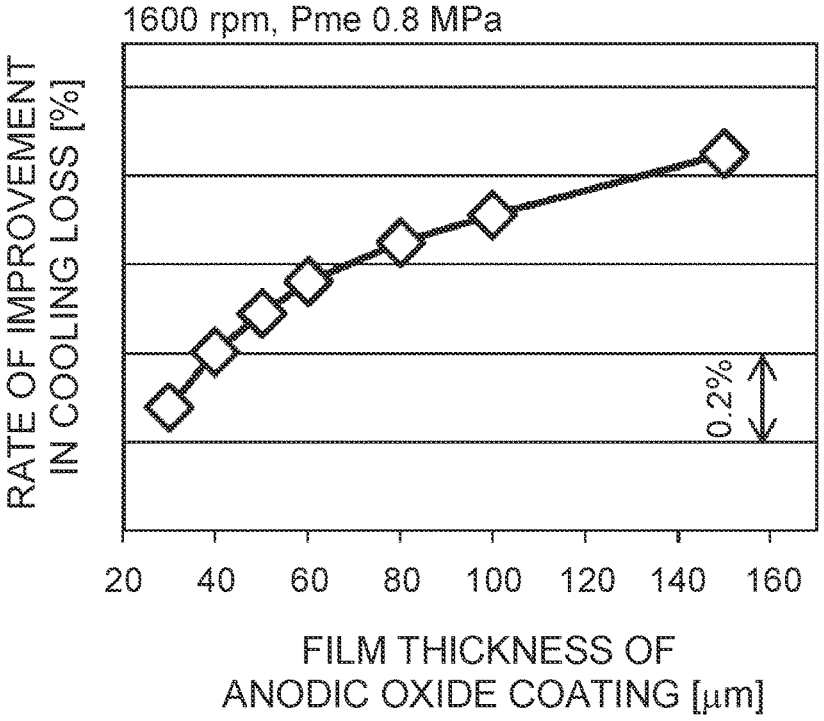
FIG. 7 shows results of simulating the rate of improvement in cooling loss using varying film thicknesses of the anodic oxide coating formed on the piston top surface.
Figure 8:
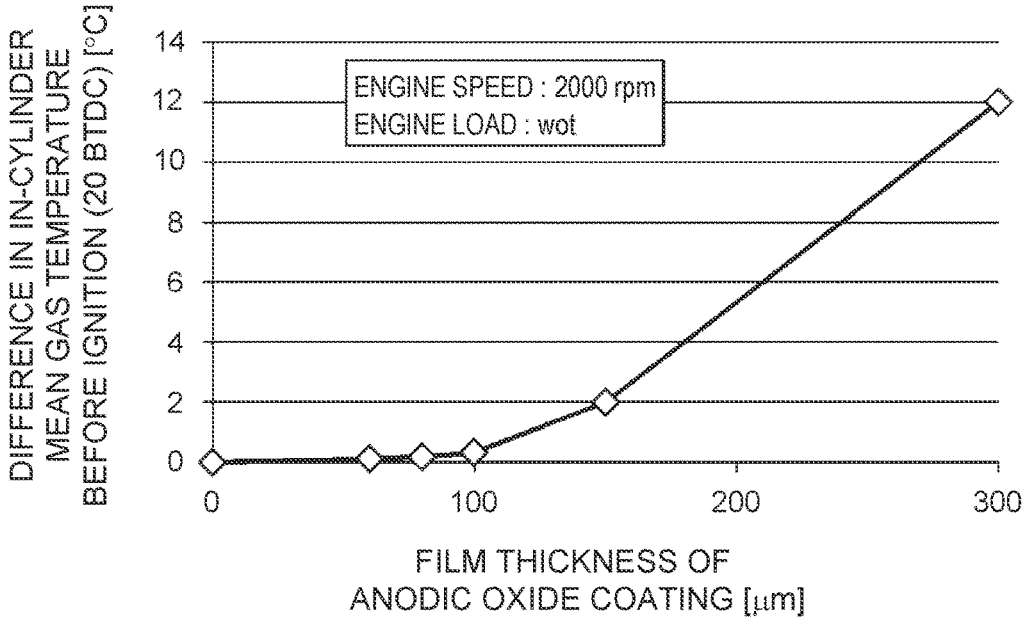
FIG. 8 shows results of simulating the difference in in-cylinder mean gas temperature using varying film thicknesses of the anodic oxide coating formed on the piston top surface.

In the present embodiment, the thin-film portion is preferably disposed in a portion substantially contributing to the formation of a tumble flow in the piston top surface. The portion substantially contributing to the formation of a tumble flow is a portion with which the tumble flow comes into active contact. In the present embodiment, the film thickness of the anodic oxide coating except for the thin-film portion is preferably larger than 60 μm and 100 μm or smaller. Hereinafter, the anodic oxide coating portion having a film thickness of larger than 60 μm and 100 μm or smaller is referred to as a thick-film portion. FIG. 7 is a graph showing results of simulating the rate of improvement in cooling loss using varying film thicknesses of the anodic oxide coating. As shown in FIG. 7, an anodic oxide coating having a larger film thickness is found to have better heat insulation properties and therefore exhibit improvement in cooling loss. On the other hand, as shown in FIG. 8, a thicker anodic oxide coating is found to increase the difference in in-cylinder mean gas temperature before ignition. The increased difference in in-cylinder mean gas temperature facilitates knocking. In the present embodiment, the thin-film portion having a film thickness of 15 μm or larger and 60 μm or smaller is disposed in the portion substantially contributing to the formation of a tumble flow in the piston top surface. The thin anodic oxide coating in the portion substantially contributing to the formation of a tumble flow can effectively curb intake heating in a high-rpm region (see FIG. 6). On the other hand, in the present embodiment, the film thickness of the anodic oxide coating except for the thin-film portion disposed in the portion substantially contributing to the formation of a tumble flow is set to larger than 60 μm and 100 μm or smaller from the viewpoint of reducing cooling loss and knocking. An anodic oxide coating as thick as possible is preferred as shown in FIG. 7 from the viewpoint of cooling loss, whereas too thick an anodic oxide coating is susceptible to knocking as shown in FIG. 8. Hence, the upper limit of the film thickness of the anodic oxide coating is set to 100 μm for the balance between reduction in cooling loss and reduction in knocking. When the film thickness of the anodic oxide coating is 100 μm or smaller, the difference in in-cylinder mean gas temperature is less than 1° C. as understood from FIG. 8. Thus, knocking can be effectively reduced. As described above, in the present embodiment, intake heating is effectively curbed by preparing the thin-film portion as a portion substantially contributing to the formation of a tumble flow in the anodic oxide coating formed on the piston top surface. Also, the thick-film portion is prepared as the other portion from the viewpoint of cooling loss. In this respect, the upper limit of the film thickness is set to 100 μm from the viewpoint of reduction in knocking. The resulting internal combustion engine can strike a balance among curbing of intake heating, reduction in cooling loss, and reduction in knocking.

Hereinafter, the aforementioned embodiment will be specifically described.

Figure 9:
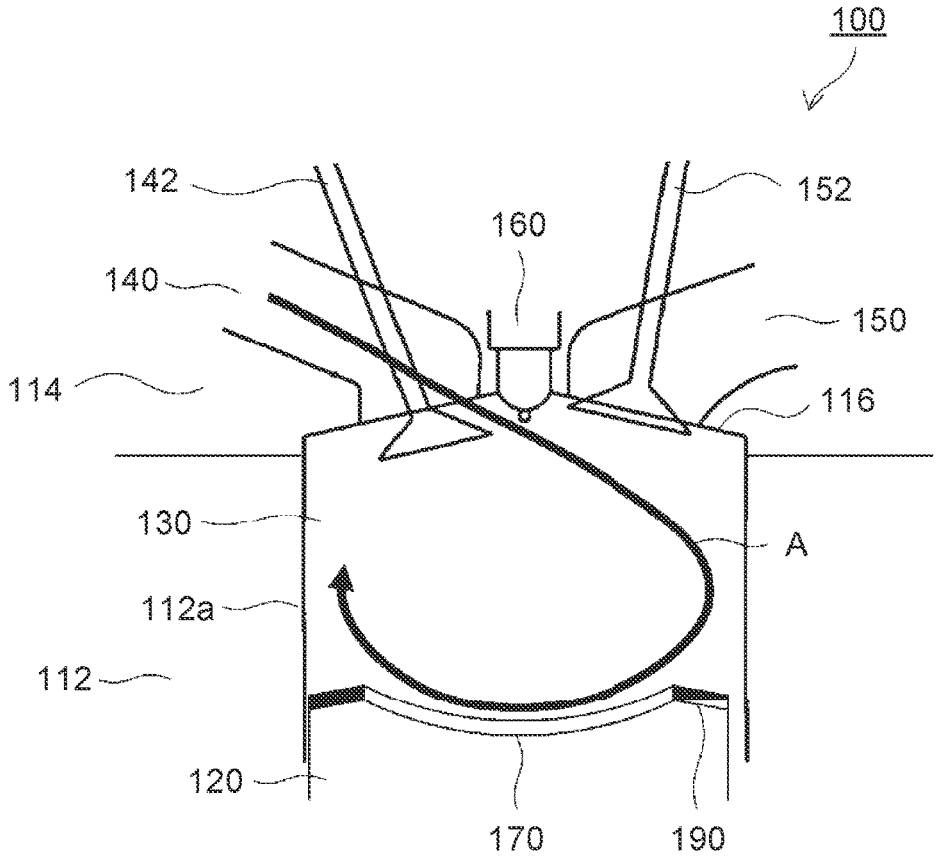
FIG. 9 is a diagrammatic sectional view showing a configuration example of the internal combustion engine according to the present embodiment.

FIG. 9 is a diagrammatic sectional view showing a configuration example of the internal combustion engine according to the present embodiment. An internal combustion engine 100 has a cylinder block 112, a cylinder head 114 that is fastened to the cylinder block 112, and a piston 120 that reciprocates in a bore formed in the cylinder block 112. A combustion chamber 130 is defined by a pent roof-shaped in-cylinder ceiling portion 116 on the lower surface of the cylinder head 114, an inner wall 112*a* of the cylinder block 112, and the top surface of the piston 120 (piston top surface). An intake port 140 and an exhaust port 150 that communicate with the combustion chamber 130 are formed in the cylinder head 114 and have an intake valve 142 and an exhaust valve 152, respectively, at their opening ends on the combustion chamber 130 side. FIG. 9 shows only one each of the intake port 140 and the exhaust port 150, though the numbers of the intake port 140 and the exhaust port 150 are not limited thereto. In general, two intake ports 140 and two exhaust ports 150 are disposed in the cylinder head 114. An ignition plug 160 is disposed in almost the middle of the combustion chamber 130, in other words, in almost the middle of the pent roof-shaped in-cylinder ceiling portion 116.

Figure 10:
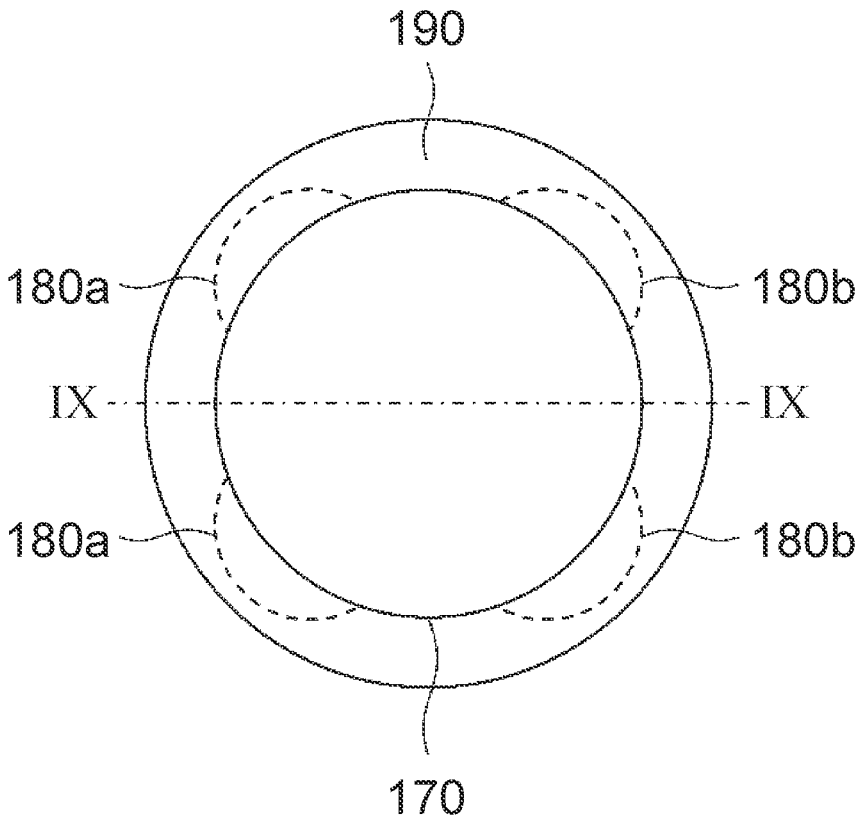
FIG. 10 is a diagrammatic plane view showing a configuration example of a piston top surface.

FIG. 10 is a diagrammatic plane view showing a configuration example of the piston top surface. The piston 120 shown in FIG. 9 corresponds to a sectional view at the IX-IX line in FIG. 10. As shown in FIG. 10, a cavity portion 170 depressed on a side opposite to the cylinder head 114 (in the downward direction of FIG. 9) is formed in the central region of the piston top surface. The cavity portion 170 thus provided can curb the attenuation of a tumble flow A (see FIG. 9). The cavity portion 170 efficiently generates a tumble and thereby induces disturbance in an air-fuel mixture, so that a combustion rate can be improved. The tumble flow may be utilized as a means for injection stratified charge. An injector (not shown) is generally disposed in the cylinder head 114 in a state where the tip of the injector faces the middle of the cavity portion 170.

In order to circumvent the interference between the intake valve 142 and the exhaust valve 152, intake valve recess portions 180*a* and exhaust valve recess portions 180*b* are also formed on the piston top surface. In FIG. 10, the intake valve recess portions 180*a* and the exhaust valve recess portions 180*b* are indicated by dotted line. In the example shown in FIG. 10, the intake valve recess portions 180*a* and the exhaust valve recess portions 180*b* are partially formed on the outer side from the cavity portion 170 with respect to the center of the piston top surface. The depths of the intake valve recess portions 180*a* and the exhaust valve recess portions 180*b* are appropriately set. For example, the position of a valve recess surface can be set to a position higher than the position of the lowest point of a cavity surface. In the example shown in FIG. 10, two intake valve recess portions 180*a* and two exhaust valve recess portions 180*b* corresponding to two intake valves and two exhaust valves, respectively, are formed on the piston top surface, and these four valve recesses are disposed with mutual spaces in the circumferential direction of the cylinder.

In FIG. 10, a squish portion 190 that forms a squish flow in cooperation with the in-cylinder ceiling portion 116 is further formed on the outer side of the cavity portion 170, the intake valve recess portions 180*a* and the exhaust valve recess portions 180*b* in the piston top surface. Owing to the presence of the squish portion 190, a gas in a squish area is ejected by the movement of the piston to the top dead center side at the time of a compression stroke (particularly, at the late stage of the compression stroke), so that the gas flows into the cavity. As a result, a squish flow can be generated.

In the present embodiment, as shown in FIG. 9, preferably, the piston top surface includes the cavity portion 170, and the aforementioned thin-film portion having a film thickness of 15 μm or larger and 60 μm or smaller is formed in the cavity portion 170. As mentioned above, the cavity portion corresponds to a portion substantially contributing to the formation of a tumble flow. Hence, the anodic oxide coating disposed in the cavity portion can effectively curb intake heating. When the piston top surface further includes valve recess portions consisting of the intake valve recess portions 180*a* and the exhaust valve recess portions 180*b*, the thin-film portion having a film thickness of 15 μm or larger and 60 μm or smaller is preferably also formed in the valve recess portions in addition to the cavity portion. The valve recess portions are also portions with which the tumble flow comes into active contact, and are considered as portions substantially contributing to the formation of a tumble flow. Therefore, the anodic oxide coating in these portions is also preferably prepared as the thin-film portion. The film thickness of the anodic oxide coating except for the thin-film portion formed on the piston top surface is preferably larger than 60 μm and 100 μm or smaller. As mentioned above, the thickness as large as possible of the anodic oxide coating in the piston top surface except for the portion substantially contributing to the formation of a tumble flow is preferred from the viewpoint of cooling loss, and the upper limit of the film thickness is set to 100 μm from the viewpoint of reduction in knocking. The resulting internal combustion engine can strike a balance among curbing of intake heating, reduction in cooling loss, and reduction in knocking. Examples of the portion in which the thick-film portion is formed include the aforementioned squish portion 190. In FIG. 9, the thick-film portion is formed on the squish portion 190.

Figure 11:
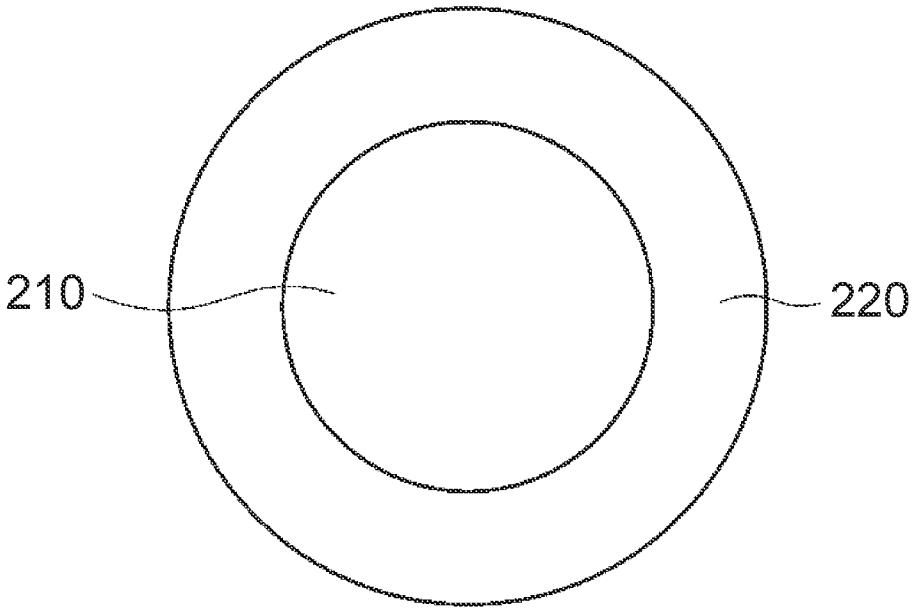
FIG. 11 is a diagrammatic plane view showing a configuration example of the piston top surface.

In FIGS. 9 and 10, the mode in which the portion substantially contributing to the formation of a tumble flow is the cavity portion is described, though the present embodiment is not limited thereto. In the present embodiment, for example, as shown in FIG. 11, the thin-film portion may be disposed in a central region 210 including the center of the piston top surface in a plane view of the piston top surface, and the thick-film portion may be disposed in an outer region 220 surrounding the central region on the outer side. Specifically, the present embodiment can be configured such that the thin-film portion is disposed in a central region including the center of the piston top surface, and the anodic oxide coating disposed in an outer region positioned on the outer side of the central region has a film thickness of larger than 60 μm and 100 μm or smaller. The tumble flow comes into active contact with the central region including the center of the piston top surface. Hence, for the aforementioned reason, it is preferred to dispose the thin-film portion in the central region and to dispose the thick-film portion in the outer region. The resulting internal combustion engine can strike a balance among curbing of intake heating, reduction in cooling loss, and reduction in knocking. The ratio between the area Sc of the central region and the area So of the outer region (Sc:So) is, for example, 1:5 to 5:1, 1:4 to 4:1, or 1:3 to 3:1. The shape of the central region is not particularly limited and is, for example, substantially circular or substantially oval. The center of the piston top surface means, for example, a barycenter.

The thin-film portion and the thick-film portion can be established in the piston top surface through the use of, for example, masking. In general, the anodic oxide coating has a large film thickness on a casting surface and has a small film thickness on a polished surface. The thin-film portion and the thick-film portion can be established through the use of this fact. The thin-film portion and the thick-film portion can be established, for example, through one coating treatment step by anodizing a piston top surface having a cavity portion and valve recess portions formed from a polished surface, and a squish portion formed from a casting surface.

Hereinafter, the present embodiment will be described with reference to Examples. However, the present embodiment is not limited by Examples given below.

Aluminum-based base materials (base materials A and B) having the composition of components shown in Table 1 below were provided.

TABLE 1

| | Cu | Si | Mg | Zn | Fe | Mn | Ti | Al |
|---|---|---|---|---|---|---|---|---|
| Base Material A | 0.8 | 12 | 0.78 | 0.11 | 0.18 | <0.01 | <0.01 | Balance |
| Base Material B | 0.0 | 2.0 | 0.78 | 0.11 | 0.18 | <0.01 | <0.01 | Balance |

(Unit: % by Mass %)

EXAMPLE 1

In Examples, an anodic oxide coating was formed on each of the aluminum-based base materials A and B using an apparatus having the configuration as shown in FIG. 15. Specifically, the base material A was dipped in an aqueous sulfuric acid solution (electrolytic solution), and energization was carried out with the base material A as an anode and SUS as a cathode. In this configuration, the energization occurred between the surface to be treated and the cathode by masking the base material surface except for the surface to be treated. The sulfuric acid concentration of the electrolytic solution was 20% by mass, and the temperature of the electrolytic solution (bath temperature) was set to 5° C. The energization was performed at a current density of 0.5 A/cm2 using a direct-current power source. The film formation time was set to 40 seconds. The flow rate of the electrolytic solution from the discharge portion was set to 20 L/min. After the completion of energization, the base material was taken out of the electrolytic solution and thoroughly washed with distilled water. Water was removed by the blowing of compressed air, followed by thorough drying in the atmosphere to prepare a test piece E1.

EXAMPLE 2

A test piece E2 was prepared in the same way as in Example 1 except that the flow rate of the electrolytic solution from the discharge portion was set to 25 L/min.

EXAMPLE 3

A test piece E3 was prepared in the same way as in Example 1 except that the flow rate of the electrolytic solution from the discharge portion was set to 30 L/min.

COMPARATIVE EXAMPLE 1

A test piece C1 was prepared in the same way as in Example 1 except that the base material B was used instead of the base material A.

COMPARATIVE EXAMPLE 2

A test piece C2 was prepared in the same way as in Comparative Example 1 except that the flow rate of the electrolytic solution from the discharge portion was set to 25 L/min.

COMPARATIVE EXAMPLE 3

A test piece C3 was prepared in the same way as in Example 1 except that the flow rate of the electrolytic solution from the discharge portion was set to 5 L/min.

COMPARATIVE EXAMPLE 4

A test piece C4 was prepared in the same way as in Example 1 except that the flow rate of the electrolytic solution from the discharge portion was set to 15 L/min.

Measurement of Film Thickness of Anodic Oxide Coating

As a result of measuring the film thickness of the anodic oxide coating as to the obtained test pieces E1 to E3 and C1 to C4, all the film thicknesses were 15 nm. The film thickness of the anodic oxide coating was measured by observing the cross-section of the coating under SEM, measuring film thicknesses at 5 sites, and determining an average value.

Measurement of Porosity

The porosity was measured as to the obtained test pieces E1 to E3 and C1 to C4 by the following method: the volume of the coating was determined from the area and the film thickness of the anodic oxide coating. Also, the weight of the coating was determined from the difference in weight before and after removal of the coating. The bulk density of the coating was calculated. The porosity was calculated according to the following expression using the obtained bulk density of the coating and an alumina density (3.9 g/cm$^3$):

$$\text{Porosity}=1-(\text{Bulk density of the coating}/\text{Alumina density})$$

The results are shown in Table 2.

Measurement of Surface Opening Diameter of Nanopore

The surface opening diameter of the nanopores was measured as to the obtained test pieces E1 to E3 and C1 to C4 by the following method: the surface of the anodic oxide coating was photographed under SEM to obtain a SEM image. The circle-equivalent diameter of the nanopores was determined from the obtained SEM image using image analysis software WinROOF (manufactured by Mitani Corp.).

Measurement of Inside Diameter of Nanopore

The inside diameter of the nanopores was measured as to the obtained test pieces E1 to E3 and C1 to C4 by the following method: the anodic oxide coating was shaved using a cross-section polisher or the like, and the exposed surface was photographed under SEM to obtain a SEM image. The circle-equivalent diameter of the nanopores was determined from the obtained image using image analysis software WinROOF (manufactured by Mitani Corp.).

Measurement of 40° C.-Fall Time (Test to Evaluate Swing Characteristics)

The swing characteristics of the anodic oxide coating were evaluated as to the obtained test pieces E1 to E3 and C1 to C4 by the following method.

Figure 12A:
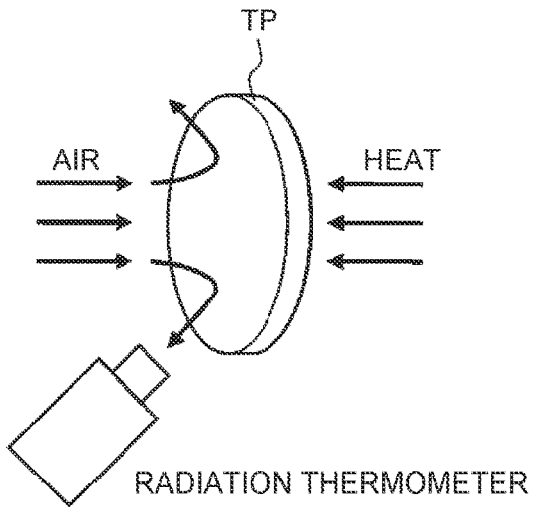
FIG. 12A is a schematic view summarizing a cooling test.
Figure 12B:
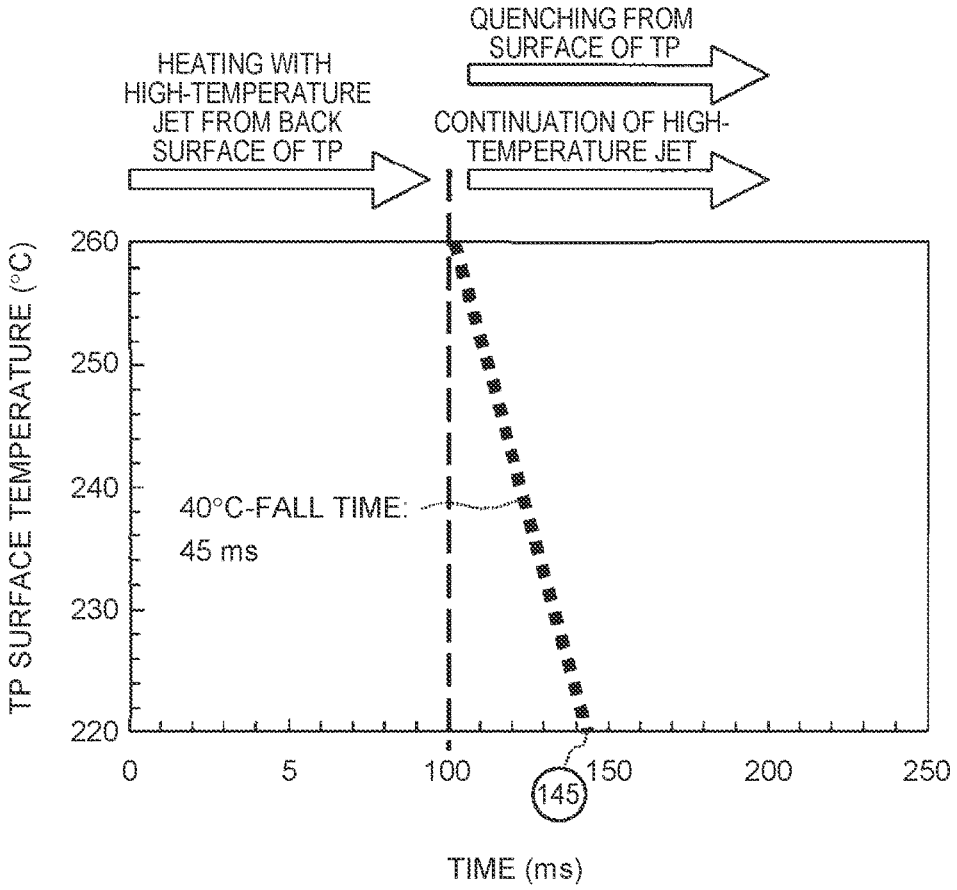
FIG. 12B is a view showing a cooling curve based on cooling test results, and a 40° C.-fall time determined from the cooling curve.

As shown in FIG. 12A, the aforementioned test piece (TP) provided on one surface with the anodic oxide coating was used. The back surface (surface provided with no anodic oxide coating) was heated by high-temperature injection of 750° C., so that the whole test piece was kept at a constant temperature on the order of 250° C. Next, a nozzle in which a jet of room temperature was allowed in advance to flow at the predetermined flow rate was moved to the front surface (surface provided with the anodic oxide coating) of the test piece to start cooling. Cooling air of 25° C. was provided from the nozzle while the high-temperature injection to the back surface was continued. Then, the surface temperature of the anodic oxide coating in the test piece was measured with a radiation thermometer, and a temperature fall during the cooling was measured to prepare the cooling curve shown in FIG. 12B. This cooling test is a testing method mimicking the intake stroke of the inner wall of a combustion chamber and evaluates the cooling rate of a heated surface of a heat insulation coating. A heat insulation coating having a low thermal conductivity and a low thermal capacity exhibits a tendency to accelerate a quenching rate. The time required for the coating surface temperature to fall by 40° C. was read from the prepared cooling curve and used as a 40° C.-fall time to evaluate the thermal characteristics of the coating.

Figure 13:
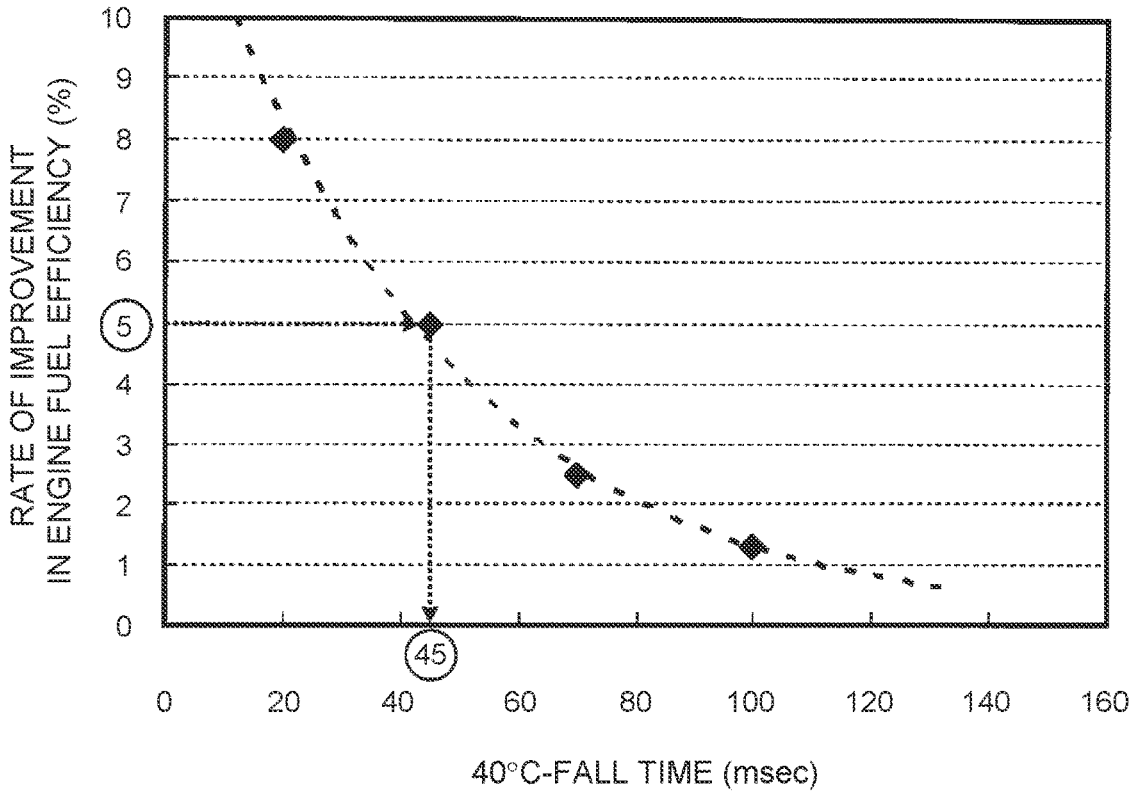
FIG. 13 is a view showing a graph of the correlation between the rate of improvement in fuel efficiency and the 40° C.-fall time in the cooling test.

One example of a targeted value achieved by the capabilities of the anodic oxide coating includes 5% improvement in fuel efficiency. This 5% improvement in fuel efficiency is a value that can clearly demonstrate the rate of improvement in fuel efficiency without being buried as a measurement error in an experiment, and can achieve reduction in NOx by shortening the warm-up time of a NOx reduction catalyst through the elevation of an exhaust gas temperature. In this context, FIG. 13 shows a graph of the correlation between the rate of improvement in fuel efficiency and the 40° C.-fall time in the cooling test defined by the present inventors. From this FIG. 13, the 40° C.-fall time in the cooling test corresponding to the 5% improvement in fuel efficiency was defined as 45 msec, and 45 msec or shorter can be used as an index indicating excellent swing characteristics.

The results of measuring the porosity and evaluating the swing characteristics are shown in Table 2 below.

TABLE 2

| | Base Material | Current Density (A/cm$^2$) | Film Formation Time (sec) | Flow Rate (L/min) | Film Thickness (μm) | Porosity (%) | Surface Opening Diameter (nm) | Inside Opening Diameter (nm) | 40° C.-Fall Time (msec) |
|---|---|---|---|---|---|---|---|---|---|
| Example 1 | A | 0.5 | 40 | 20 | 15 | 23 | 20 | 30 | 45 |
| Example 2 | A | 0.5 | 40 | 25 | 15 | 23 | 7 | 30 | 45 |
| Example 3 | A | 0.5 | 40 | 30 | 15 | 23 | 0 | 30 | 45 |
| Comparative Example 1 | B | 0.5 | 40 | 20 | 15 | 19 | 20 | 30 | 65 |
| Comparative Example 2 | B | 0.5 | 40 | 25 | 15 | 19 | 10 | 30 | 55 |
| Comparative Example 3 | A | 0.5 | 40 | 5 | 15 | 23 | 50 | 40 | 55 |
| Comparative Example 4 | A | 0.5 | 40 | 15 | 15 | 23 | 30 | 40 | 50 |

Figure 14:
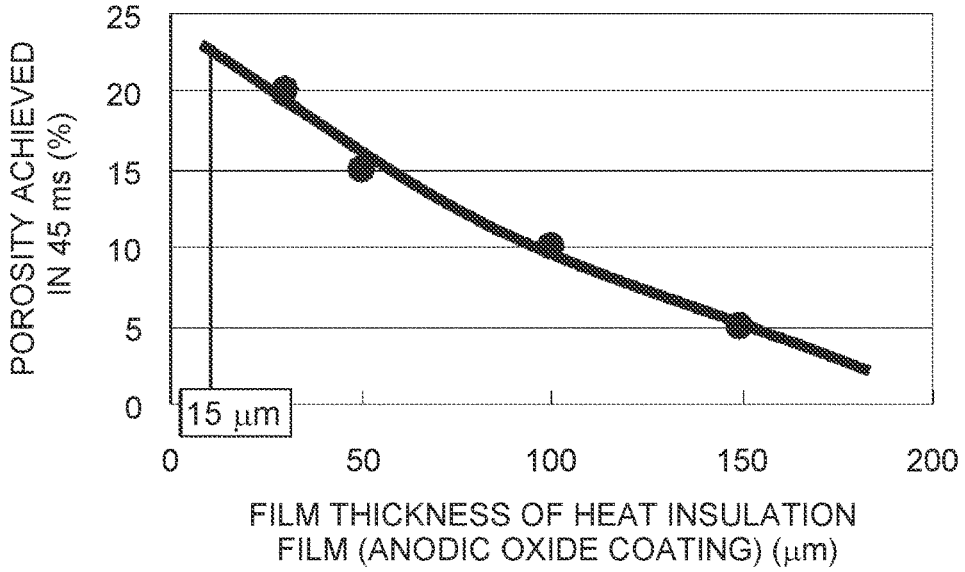
FIG. 14 is a view showing experimental results about the relationship between a porosity achieved in 45 msec and the film thickness of the anodic oxide coating.

As is evident from Table 2, a 40° C.-fall time of 45 msec was obtained in Examples 1 to 3, and the test pieces E1 to E3 exhibited excellent swing characteristics. FIG. 14 is a view showing experimental results about the relationship between the porosity achieved in 45 msec and the film thickness of the anodic oxide coating. As shown in FIG. 14, a thicker anodic oxide coating was found to decrease the porosity of the anodic oxide coating necessary for satisfying the 40° C.-fall time of 45 msec. In short, the film thickness of the anodic oxide coating according to the present embodiment is defined to be 15 μm or larger. Therefore, the anodic oxide coating having a porosity of 23% or more satisfies the 40° C.-fall time of 45 msec.

The embodiments of the present disclosure are described above with reference to the drawings. However, the specific configuration is not limited by the embodiments given herein. Even various changes, modifications, and the like made in design, etc. without departing from the present disclosure are included in the scope of the present disclosure.

What is claimed is:

1. An internal combustion engine, comprising:

an anodic oxide coating formed on at least a portion of an aluminum-based wall surface facing a combustion chamber, wherein the anodic oxide coating has a plurality of nanopores extending substantially in a thickness direction of the anodic oxide coating, a first micropore extending from a surface toward an inside of the anodic oxide coating, and a second micropore present in the inside of the anodic oxide coating;

a surface opening diameter of the nanopores on the surface of the anodic oxide coating is 0 nm or larger and smaller than 30 nm;

an inside diameter of the nanopores in the inside of the anodic oxide coating is larger than the surface opening diameter;

a film thickness of the anodic oxide coating is 15 μm or larger and 130 μm or smaller; and a porosity of the anodic oxide coating is 23% or more.

2. The internal combustion engine according to claim 1, wherein a difference between the surface opening diameter and the inside diameter of the nanopores is 7 nm or larger.

3. The internal combustion engine according to claim 1, wherein the nanopores do not open to the surface of the anodic oxide coating.

4. The internal combustion engine according to claim 3, wherein a difference between the surface opening diameter and the inside diameter of the nanopores is 20 nm or larger.

5. The internal combustion engine according to claim 1, wherein an aluminum-based material constituting the aluminum-based wall surface contains at least one metal selected from Si and Cu; and a content of the metal in the aluminum-based material is 5% by mass or more.

6. The internal combustion engine according to claim 1, wherein no sealing material is disposed on the anodic oxide coating.

7. The internal combustion engine according to claim 6, wherein the anodic oxide coating is exposed to the combustion chamber.

8. The internal combustion engine according to claim 1, wherein the internal combustion engine has a piston; and the anodic oxide coating is formed at least on a piston top surface.

9. The internal combustion engine according to claim 8, wherein the anodic oxide coating formed on the piston top surface comprises a thin-film portion having the film thickness of 15 μm or larger and 60 μm or smaller.

10. The internal combustion engine according to claim 9, wherein the thin-film portion is disposed in a portion substantially contributing to a formation of a tumble flow in the piston top surface.

11. The internal combustion engine according to claim 10, wherein the film thickness of the anodic oxide coating formed on the piston top surface except for the thin-film portion is larger than 60 μm and 100 μm or smaller.

12. The internal combustion engine according to claim 9, wherein the piston top surface comprises a cavity portion; and the thin-film portion is disposed in the cavity portion.

13. The internal combustion engine according to claim 12, wherein the piston top surface further comprises valve recess portions; and the thin-film portion is also disposed in the valve recess portions in addition to the cavity portion.

14. The internal combustion engine according to claim 12, wherein the piston top surface further comprises a squish portion; and the film thickness of the anodic oxide coating in the squish portion is larger than 60 μm and 100 μm or smaller.

15. The internal combustion engine according to claim 9, wherein the thin-film portion is disposed in a central region including a center of the piston top surface; and the film thickness of the anodic oxide coating disposed in an outer region positioned on an outer side of the central region is larger than 60 μm and 100 μm or smaller.

16. The internal combustion engine according to claim 15, wherein a ratio between an area of the central region and an area of the outer region is 1:5 to 5:1.

* * * * *